US005856173A

United States Patent [19]

Riley et al.

[11] Patent Number: 5,856,173

[45] Date of Patent: Jan. 5, 1999

[54] APPARATUS FOR COMMINUTING ORGANIC WASTE AND INJECTING BIO-ENZYMES INTO THE WASTE

[75] Inventors: Wayne C. Riley, Sturtevant; Nicholas J. Hirsch, Windlake; Thomas J. Weber, Oak Creek; Steven S. Landowski, Franksville, all of Wis.

[73] Assignee: Emerson Electric Co., St. Louis, Mo.

[21] Appl. No.: 863,517

[22] Filed: May 27, 1997

[51] Int. Cl.[6] ..... D06M 16/00

[52] U.S. Cl. ..... 435/264; 435/290.2; 435/290.4; 4/DIG. 4; 222/333; 222/321.7; 241/36; 241/39; 241/101.2; 241/DIG. 38

[58] Field of Search ..... 435/286.1, 286.7, 435/289.1, 304.1, 264, 290.2, 290.4; 4/DIG. 4; 241/36, 33, 38, 39, 101.2, 101.5, DIG. 38; 510/111, 194, 393, 530; 222/333, 504, 321.7

[56] References Cited

U.S. PATENT DOCUMENTS

| | | | |
|---|---|---|---|
| 4,797,208 | 1/1989 | Miller et al. | 210/606 |
| 4,910,808 | 3/1990 | Roth | 4/222 |
| 4,911,832 | 3/1990 | Miller et al. | 210/86 |
| 4,967,935 | 11/1990 | Celest | 222/63 |
| 5,464,766 | 11/1995 | Bruno | 435/187 |
| 5,577,673 | 11/1996 | McMurphy | 241/33 |
| 5,632,414 | 5/1997 | Merriweather | 222/52 |

FOREIGN PATENT DOCUMENTS

| | | | |
|---|---|---|---|
| 0 608 555 | 8/1994 | European Pat. Off. | C05F 9/02 |
| 0 611 742 | 8/1994 | European Pat. Off. | C05F 9/02 |
| 401236983 | 9/1989 | Japan | B09B 3/00 |
| 406339671 | 12/1994 | Japan | B09B 3/00 |

*Primary Examiner*—David A. Redding
*Attorney, Agent, or Firm*—Ryan Kromholz & Manion

[57] ABSTRACT

An organic waste disposer 10 such as is commonly mounted to a kitchen sink 12 has mounted next to it a device 14 for injecting a predetermined quantity of bio-enzyme material into the disposer's grinding chamber each time the motor of the disposer is turned on.

22 Claims, 4 Drawing Sheets

FIG. 4
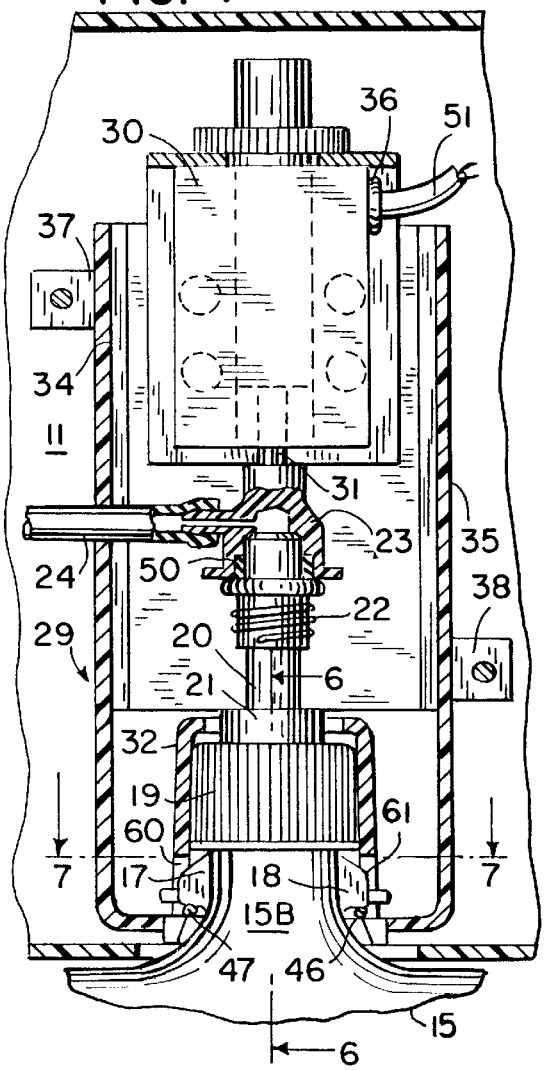
FIG. 5
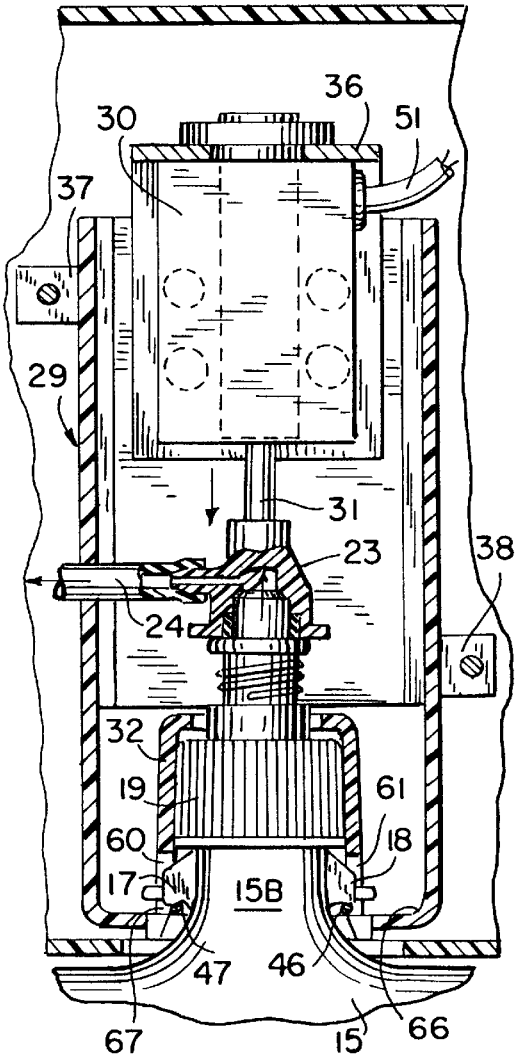
FIG. 7
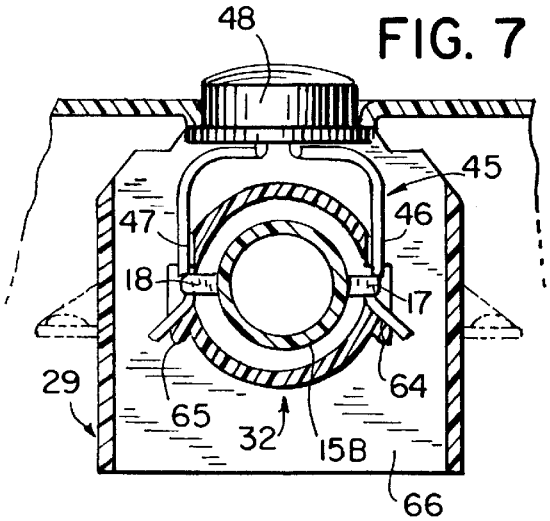
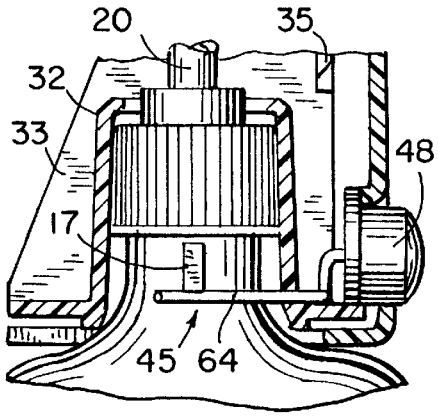
FIG. 6

APPARATUS FOR COMMINUTING ORGANIC WASTE AND INJECTING BIO-ENZYMES INTO THE WASTE

BACKGROUND OF THE INVENTION

The invention disclosed herein pertains to motor operated organic waste disposers, such as food waste disposers that are commonly mounted to a kitchen sink, for receiving and grinding food waste, along with water, into fine particles which are flushed out and ultimately arrive in a public sewer system or a septic tank.

It is well known that some soaps and fats from the kitchen sink and other food waste that is discharged from a disposer can build up deposits on the interior of the piping running from the disposer to the ultimate destination of the waste. In due course, the deposited layer thickens and either impairs drainage or completely blocks it. When there is complete blockage, the common practice has been to introduce a caustic material into the piping system, usually through a sink drain, in expectation that the caustic material will react with and dissolve the deposits for being flushed away. The caustic material is known to cause toxic shock and other harm to the bacteria that act on the waste in a septic tank.

Some householders now introduce bio-enzyme products into the drain piping to digest and loosen or remove waste deposits so they can be flushed away with water. Bio-enzyme products have demonstrated a capability for consuming organic waste in piping and in other accumulators of waste such as septic tanks.

A septic tank depends on bacteria and on the enzymes produced by bacteria to digest waste material that is fed into the tank. The digested material constitutes a fluidized layer that can be conducted to leaching beds. A beneficial quantity of bacteria must be maintained at a certain level for the septic tank to function properly and efficiently. However, in many cases, all waste water generated in a dwelling is conducted to a septic tank. Waste water discharged from a dwelling often contains substances that causes toxic shock to bacteria which might be otherwise active in digesting waste deposited in piping or in a septic tank. Common examples of such deleterious substances are caustic materials such as lye, used for cleaning drains, detergents, bactericidal hand and dishwashing detergents and soap, acids such as from citrus fruits, chlorine bleaches from clothes washing machines, antibiotics from medications as well as various chemicals and even very hot water.

A consequence of a reduced bacteria concentration is that the septic tank becomes less efficient and congested with undigested solids and thereby inhibits infeed of organic waste and the water that entrains it. When this condition is reached, the usual remedy is to have the tank pumped out by an expert who supplies the service. Sometimes a fresh quantity of bio-enzymes is introduced into the septic tank after it has been pumped out to condition the tank for receiving and digesting organic waste. It would be desirable if the bio-enzyme concentration in the piping leading to the tank and to the tank itself could be held at a high level such that pipe clogging and the frequency of pumping out the contents of the tank would be reduced.

Bacteria materials for producing bio-enzymes are available for purchase in retail stores. Some householders have adopted the practice of keeping their drain piping and sewerage system clear of organic deposits by introducing such materials periodically into the plumbing system. In this way they can compensate for the reduction in bio-enzyme concentration in the sewerage system that has resulted from toxic shock. However, septic tank owners are unlikely to develop and follow a regular schedule for introducing fresh bio-enzyme yielding materials into the plumbing and septic tank. It will be apparent that it would be highly desirable to have a device for automatically introducing fresh bio-enzyme yielding bacteria concentrate into drain pipes daily to offset daily toxic shock whether the destination of the organic waste is a public sewerage system or a septic tank. Daily additions of bio-enzyme provides bacterial seeding that allows the septic system to restore and maintain a required level of efficiency.

SUMMARY OF THE INVENTION

An objective of the invention is to provide a device for admitting bio-enzymes into the organic waste disposal piping of a dwelling with practically no conscious involvement by a person.

Another objective is to provide a dispenser device for admitting the liquid phase bio-enzymes by way of a motor-driven organic waste disposer or grinder, such as a food waste disposer of the type that is popularly coupled to the drain outlet of a kitchen sink.

An important feature of the invention is its capability for accomplishing intimate mixing of the bio-enzyme with the finely divided food waste or other organic food waste in a disposer before discharging the intimately mixed waste and enzymes into the piping system so there will be assurance that bio-enzymes are mixed with the food waste to accelerate its breakdown and help maintain a presence of bio-enzyme in the entire length of the piping as well as in the septic tank. This improves the digestion of the sewage in the septic tank and keeps the pipes free of buildup.

Hereinafter the substance injected into a food waste disposer for digestion of waste will be referred to as bio-enzymes or bio-enzyme material to be consistent with popular and commercial usage.

According to the invention, a disposer for organic waste, usually food waste, has associated with it a device that automatically injects a measured quantity of bio-enzymes into the disposer each time the disposer is turned on to grind waste along with water and discharge the mixture out of the disposer. The device for injecting a predetermined quantity of bio-enzymes into the disposer each time the disposer is operated comprises a bottle containing bio-enzyme material that is affiliated with the waste disposer. The bottle is provided with a pump of the type that is commonly used to dispense fluid substances such as hand lotion, liquid detergent or window cleaning fluid, for example. Such pumps cause a quantity of liquid to be discharged from a bottle by simply depressing or plunging a tubular stem projecting from the pump. An operator, such as an electromagnetic actuator is connected to the pump such that each time the motor driving the disposer is energized, the electromagnetic actuator is also energized to cause the pump to execute one pumping stroke for transferring a specified quantity of the bio-enzyme into the disposer. The consequence of this is that a measured quantity of bio-enzyme material is thoroughly mixed with the food waste which is finely ground in the disposer for being discharged with a quantity of flushing water into the sewerage piping and ultimately into a septic tank in many cases.

When the food waste disposer is deenergized after completing a grinding operation, the electrical actuator for the pump deenergizes and is restored to a state wherein it is ready for acting in response to the motor of the disposer or grinder being energized again.

The invention features a specialized bottle for containing the bio-enzymes that is easy to install or replace for replenishment of the bio-enzyme liquid. The bottle is designed for being retained in bio-enzyme dispensing position by way of a detent device which permits insertion of a bottle by simply pushing its neck end into a receiver while actuating the detent with a push button so the bottle can enter the receiver after which the push button is released for the detent to respond to its spring characteristics by engaging the bottle and holding it in the receiver.

A study has shown that households use the sink-mounted food waste disposers on an average of about two and one-half times per day. Experiments have shown that injecting about one and one-half cubic centimeters of bio-enzyme per disposer operation is satisfactory for accomplishing the intended objective of keeping the plumbing clear of deposits and a septic tank operating at peak efficiency. Thus, a suitable bottle is one that only needs to be replaced for replenishment of bio-enzyme material about every four months.

How the foregoing objective and features of the invention are achieved and implemented will be apparent in the ensuing more detailed description of a preferred embodiment of the invention which will now be set forth in reference to the accompanying drawings.

DESCRIPTION OF THE DRAWINGS

FIG. 4 is a side elevational view, partly in section, of the new bio-enzyme injection device wherein the pump is in a standby state in readiness for injecting a small quantity of bio-enzyme into the food waste disposer when the disposer is operated;

FIG. 5 is similar to FIG. 4 insofar as structure is concerned except that the electromagnetic operator of the pump is in an actuated state which corresponds to having caused the pump to draw bio-enzyme out of the storage bottle and inject a small quantity of it into the food waste disposer when the dispenser motor became energized;

FIG. 6 is a partial vertical sectional view taken on a line corresponding with the line 6—6 in FIG. 4 and depicting the engagable and releasable detent device for retaining the neck end of the bio-enzyme containing bottle within its receiver;

FIG. 7 is a transverse section taken on a line corresponding to the line 7—7 in FIG. 4 and showing a top plan view of the detent mechanism with the bio-enzyme containing bottle, shown in section, being held within the bottle receiver;

DESCRIPTION OF A PREFERRED EMBODIMENT

Figure 1:
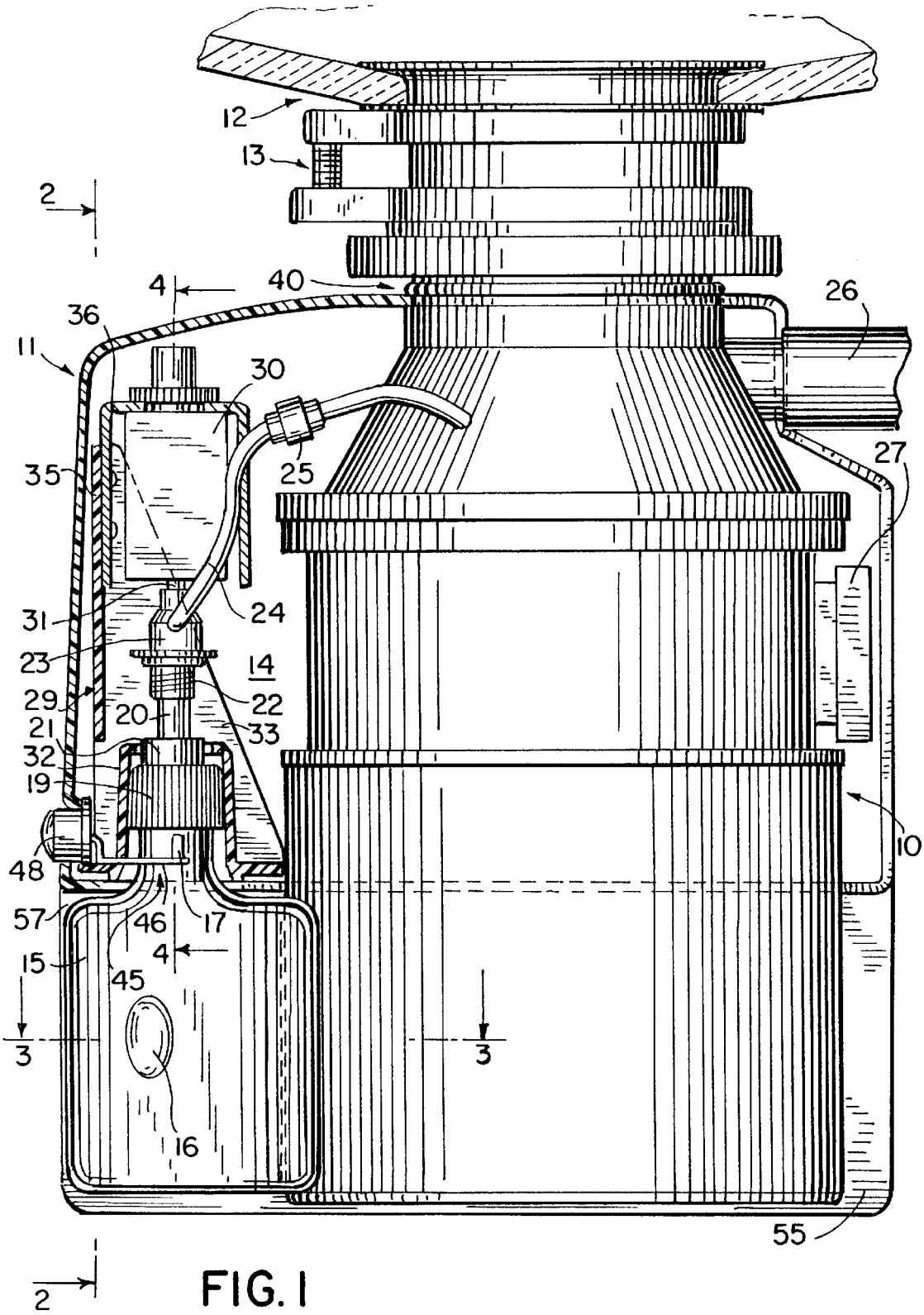
FIG. 1 is a side elevational view of a food waste disposer with the bio-enzyme injecting device shown in elevation, partly in section, and positioned within the trim shell for a food waste disposer.
Figure 2:
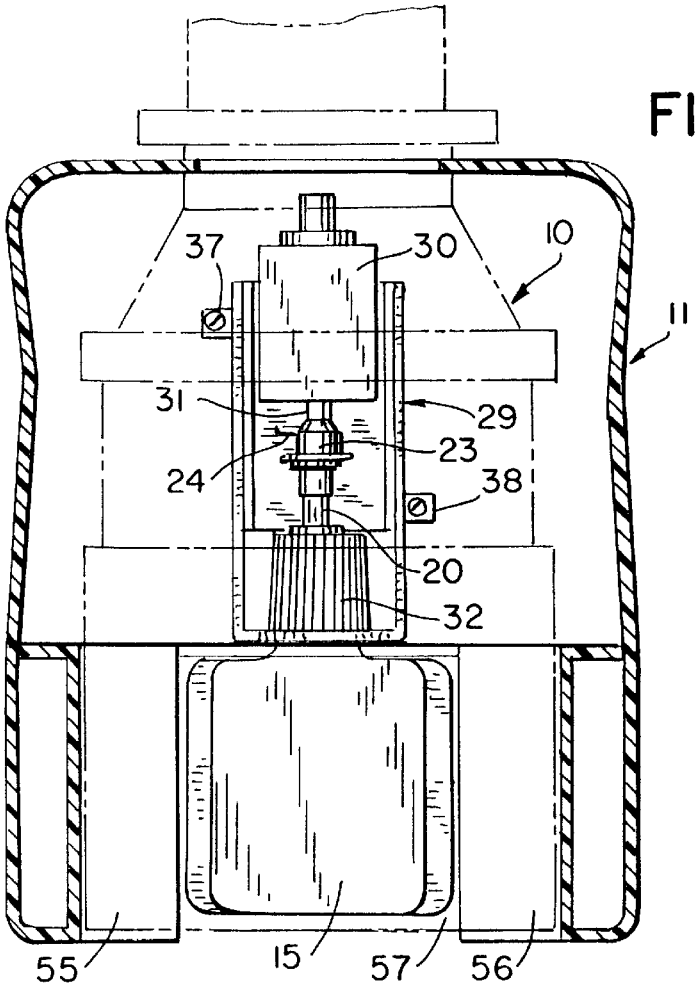
FIG. 2 is a vertical section through the trim shell and showing a front elevational view of the bio-enzyme injection device with the food waste disposer being shown in dashed lines; the section having been taken on a line corresponding to 2—2 in FIG. 1.

FIG. 1 shows a typical food waste disposer to which the bio-enzyme injection device is coupled. The food waste disposer is designated generally by the numeral 10. A decorative trim shell for the combination of the bio-enzyme injection device and food waste disposer is designated generally by the reference numeral 11. The disposer is mounted in a well-known manner in the drain opening of a sink which is designated generally by the numeral 12. The members for mounting the disposer to the sink are marked 13 and are of a well-known type which may be seen in greater detail in U.S. Pat. No. 3,025,007, which is owned by the assignee of the present application.

The food waste disposer, sometimes called a garbage grinder, may be any one of a variety of types that are available in retail hardware stores. Although the internal elements are not shown, it is well known that a food waste disposer comprises a housing containing a motor in its lower end which rotates a disk with blades or pivotal hammers within a chamber for grinding or comminuting organic waste into small particles. The particulate waste, the water injected into the disposer, and a quantity of bio-enzymes which are injected into the disposer, according to the invention are mixed and discharged through the discharge outlet 27. The inlet for passing water discharged from a dishwasher, not shown, for the grinding chamber of the disposer is marked 26. Water for grinding through the drains from the sink as is well known.

The principal components of the bio-enzyme injection device 14 will now be identified in reference to FIG. 1. A bio-enzyme containing bottle is marked 15. The bottle is preferably composed of a transparent or translucent plastic material. The body of the bottle contains at least two fingertip recesses 16 which facilitate coupling the bottle to the operating component of the bio-enzyme injection device. The neck of the bottle is provided with two radially extending diametrically opposite detent engagable elements one of which, 17, is visible in FIG. 1 and the other of which, 18, is visible in FIG. 4 and other FIGURES. The bottle has a cap 19 that provides for filling the bottle with bio-enzyme. The bottle has a pump operating tubular member or stem 20 extending out of a collar portion 21 of the bottle cap. Tubular member 20 has an externally threaded cylindrical part 22 formed on it. The upper part of the member 20 terminates in a cap 23 out of which a small quantity of bio-enzyme fluid is discharged and conducted through the agency of a flexible tube 24 to the interior of grinder chamber of food waste dispenser 10. Tube 24 preferably contains a check valve 25 which is to assure that water that is admitted to the grinder chamber cannot get into the pump. These pumps, as is well known, cause a measured quantity of liquid from a bottle to be dispensed in response to plunging the tubular member 20 downwardly and then allowing it to retract under the influence of a built-in biasing spring, which is not shown, inside of bottle 15. The pump is a generally available type which most people are familiar with in connection with using window washing fluid dispensers, hand lotion dispensers, ketchup dispensers, and the like.

Figure 11:
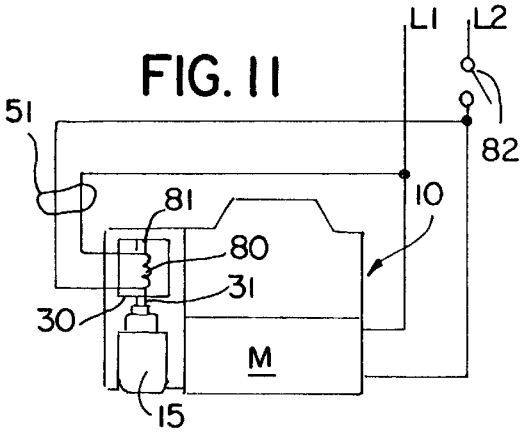
FIG. 11 is a illustration of the electrical control circuitry.

In this case, the pump's tubular member 20 is plunged downwardly to effect pumping a measured quantity of liquid by a force derived from an electromagnetic actuator that is identified in general by the reference numeral 30. Actuator 30, in this case, is basically a solenoid (see FIG. 11) operator, comprised of an electromagnet coil 80, an armature 81 and a rod 31 which is fastened to the armature. When energized, it drives rod 31 downwardly so the tubular member 20 of the pump plunges correspondingly to bring about ejection of a predetermined quantity of the bio-enzyme material into the disposer 10. The electric control circuitry is shown in FIG. 11. When the motor, M, of the food waste disposer 10 is connected to electric power source lines L1 and L2 with a switch 82. The electromagnet operating coil 81 in actuator 30 is also connected to the power lines. Thus, every time the food waste disposer is turned on to carry out an organic waste grinding operation, the pump actuator 30 is actuated to execute one pumping stroke. The actuator is a self-returning type which means that when it is deenergized concurrently with the power being turned off of the disposer motor M, the rod 31 extending from the armature 81 in the actuator 30 retracts and restores the pump stem or tubular operating member 20 to the standby position in which it is shown in FIGS. 1 and 4. In FIG. 5 the pump stem 20 is depressed so the pump has completed a pumping stroke.

In FIG. 1, the bottle 15 is installed with its cap 19 fitted into a bottle receiver 32 which is molded integrally with a bracket 33. The bracket has two side parts, to one of which the numeral 33 is applied in FIG. 1. The other side part 34, is visible in FIGS. 4, 5 and 8, for example. A rear wall 35 of the bracket provides for mounting a U-shaped member 36 to it for the member 36 to support the electromagnetic pump actuator 30. The detent device 45 is operated by the user pressing a button 48 to provide for installing and removing a bottle from receiver 32 in the bracket 29 as will be elaborated later.

FIG. 4 shows the bio-enzyme injector device with the bottle 15 installed. The external diameter of bottle cap 19 is tapered slightly so it enters the recess in bottle receiver 32 in a manner that makes it self-aligning with the movable elbow-like head 23. The tip of the tubular pump member 20 makes a sealed fit in head 23 by way of an elastic O-ring 50. In FIG. 4, the pump actuating rod 31 extending from electromagnetic operator 30 is in standby position in readiness for executing a pumping stroke. The cord by which the operator 30 is energized is marked 51. Electromagnetic operator 30 is energized by way of cord 51 concurrently with energization of the food waste disposer motor M as is evident from inspection of the FIG. 11 circuitry. The armature 81 of the electromagnetic operator 30 is retracted in FIG. 4 which means it is deenergized so no electric power is consumed by the electromagnetic operator 30 nor by the food waste disposer motor when the actuator 30 and motor M are in standby condition.

In FIG. 5, electromagnetic operator 30 is energized so that its armature-driven rod 31 has been forced downwardly during which down stroke it causes the tubular operating member 20 of the pump and head 23 to be driven downwardly to execute a single pumping stroke. Thus, electromagnetic operator 30 remains energized as long as the motor that drives the food waste disposer 10 is energized. When the motor is turned off, rod 31 and tubular member 20 of the pump are retracted under spring influence so that the bio-enzyme injection device is restored to the standby condition in which it is exhibited in FIG. 4.

Depending on the inclination of organic waste disposer users, the disposer 10 may be on some occasions pre-loaded with waste ready for being ground into fine particulates when the motor is energized while the flushing water is turned on. On other occasions, the user may turn on the flushing water, start the disposer, and then feed waste into it. In either case, as soon as the motor is energized, a charge of the bio-enzyme material is pumped into the food waste disposer for making contact with the finely-ground waste material in the disposer. Because the timing and the quantity for injection of bio-enzyme are controlled automatically, the householder is assured that the plumbing and the septic tank, if there is one on the premises, will be receiving regular injections of active bio-enzyme material for keeping the plumbing clean and the septic tank performing optimally. As indicated earlier, based on a study discovering that an organic food waste disposer is used an average of 2.3 times per day, if the amount of bio-enzyme injected by each pump stroke is about 1.6 cubic centimeters, a bottle of the bio-enzyme having a volume of about 472 cc is appropriate. Hence, the user only needs to replace an empty bottle with a full one about once every four months.

Figure 3:
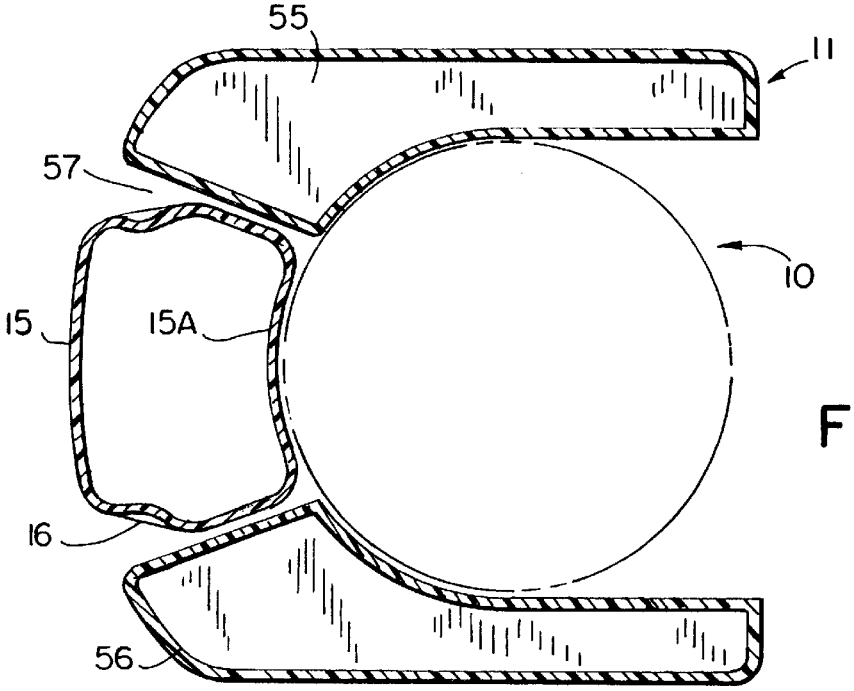
FIG. 3 is a horizontal sectional view taken on a line corresponding with the line 3—3 in FIG. 1.

As shown in FIG. 3, the radially inwardly directed wall 15A of bottle 15 is contoured for being concentric with the cylindrical body of the disposer 10. The horizontal section through the trim shell 11 in FIG. 3 shows the shell to have two side portions 55 and 56 which define a passageway 57 through which the bottle 15 can be passed upwardly for its cap 19 to nest in perfect concentricity and alignment with the interior of bottle receiver 32.

Figure 8:
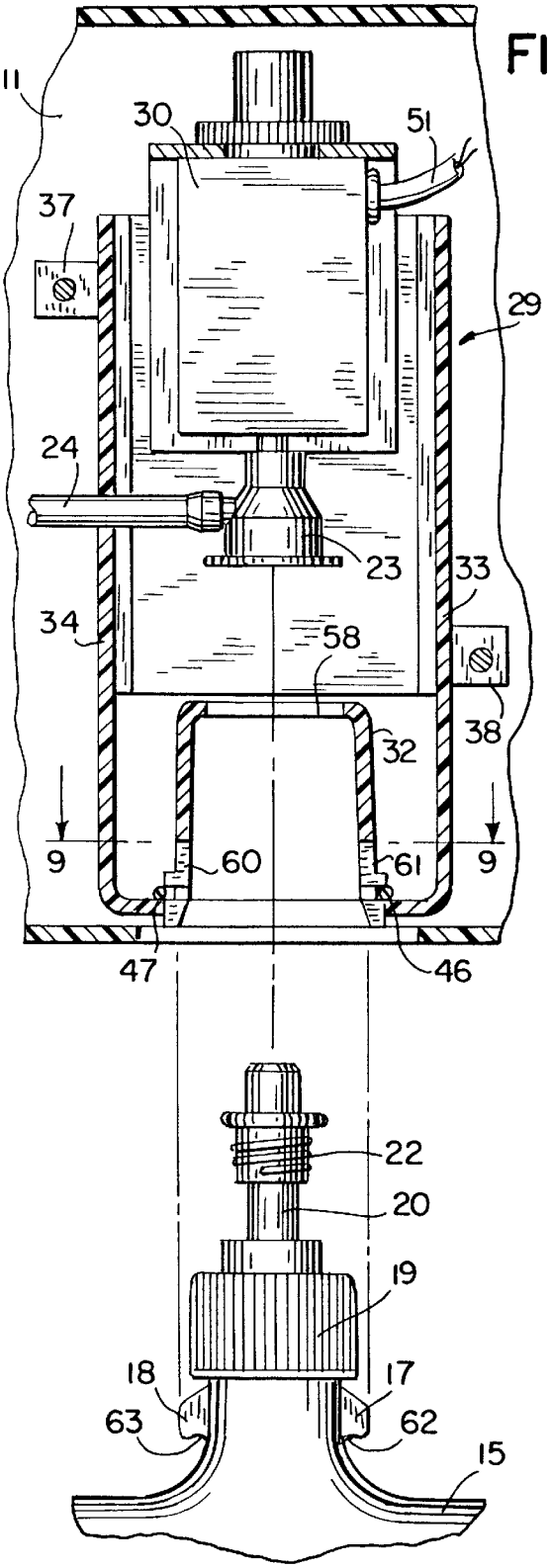
FIG. 8 is a side elevational view of the bio-enzyme injection device, partially in section, with the bottle shown in a position for being elevated into the bottle head receiver of the device.
Figure 10:
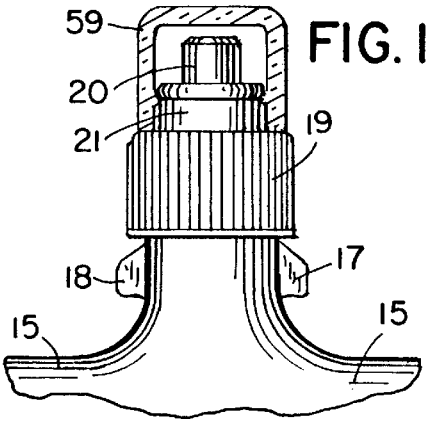
FIG. 10 is a fragmentary side elevational view of the upper end of a bottle used for containing the bio-enzyme with the pump stem protective cap shown in section.

FIG. 8 illustrates how a bottle 15 is installed in the bio-enzyme supplying device, in accordance with the invention. Before discussing installation and removal of a bottle, one should note that when a bottle is received, as shown in FIG. 10, the bottle has a cap 59 pressed onto its collar 21. Having the cap 59 installed on the bottle collar 21 is common practice and serves the purpose of preventing the pump stem 20 from losing any liquids when the bottle is being transported. In FIG. 8, the cap is removed and the thread 22 on the stem is unscrewed from collar 21 so the restraint on movement on tubular member 21 is removed. The thread 22, of course, provides for locking the pump plunger stem, that is, tubular member 20 into the bottle cap so no pump stroke can be executed when the bottle is in transit or exhibited on the shelf of a store.

In FIG. 8, bottle 15 is assumed to be presently in the hand of a user who is about to install it in the bio-enzyme dispenser device. The tubular member 20 is in line with the axis of head 23 and also with bottle receiver 32 in the dispenser device. The user, intending to install the bottle, raises it until bottle cap 19 is seated snugly and concentrically within the interior of bottle receiver 32. The member 20 then extends through the opening 58 in receiver 32 and becomes inserted in head 23 in sealed fashion because of the O-ring 50 that is installed within head 23. Two deflectable spring wires 46 and 47 of the bottle detent device support the bottle. As will be explained shortly hereinafter, spring wires 46 and 47 which can be also designated as spring rods, exert a resilient force toward each other when they are previously deflected away from each other. When the bottle is in place as in FIGS. 4 or 5, for example, the bottle support elements in the form of beveled lugs 17 and 18 on the bottle spread detent wires or rods 46 and 47 away from each other until the lugs 17 and 18 finally enter diametrically opposite slots 60 and 61 in receiver 32 and come to a stop. As bottle support elements or lugs 17 and 18 pass spring wires 46 and 47, the spring wires deflect toward each other and enter below the lower curved edges 62 and 63 of the lugs 17 and 18 on the bottle to thereby secure the bottle cap 19 in bottle receiver 32.

Figure 9:
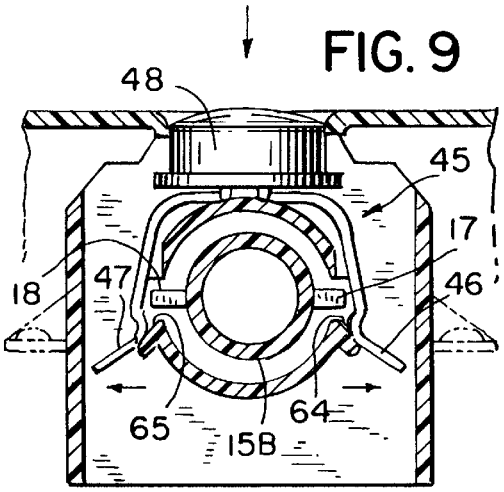
FIG. 9 is a transverse section taken on a line corresponding to the line 9—9 in FIG. 8 and showing the detent mechanism operated to a position wherein the bio-enzyme containing bottle may be in the process of being inserted into the device or withdrawn therefrom.

The details of the bottle detent device 45 are depicted in FIGS. 6, 7 and 9. Consider FIG. 9, for example, wherein the button 48 of the detent device is presently depressed as it would be when the user is in the process of installing a filled bottle or releasing an empty bottle from the bio-enzyme injection device. As shown, the receiver 32 has a wall whose margins terminate in angulated camming surfaces 64 and 65. The free ends of detent spring wires or rods 46 and 47 diverge outwardly and away from each other. Thus, when button 48 is pressed in, the diverging free ends formed on spring wires 46 and 47 slide along the camming surfaces 64 and 65 which causes them to spread apart from each other to provide for clearance between the spring wires 46 and 47 and the lugs or support elements 17 and 18 on the bottle as the bottle is either pushed upwardly or withdrawn downwardly. When the bottle reaches its installed uppermost position, the installer releases the force applied to detent control button 48 which allows the spring wires 46 and 47 to move toward each other under the influence of their spring force and reach a position under bottle support elements 17 and 18 where they get hooked in depressions 62 and 63 at the bottom edges of lugs 17 and 18. Thus, spring wires 46 and 47, by cooperating with lugs 17 and 18 on the bottle, hold the bottle in receiver 32 such that the tubular pump plunger member 20 extends into and seals into the head 23.

When the bottle is fully installed and the hand of the installer is released from the bottle, the bottle is secured in its uppermost position as is the case in FIGS. 6 and 7. FIG. 6 shows how one of the detent spring wires 64 gets under and supports the bottle by way of lug 17. FIG. 7 shows the spring wires 46 and 47 contracted towards each other under the influence of their own resiliency so as to remain under the lugs 17 and 18 of the bottle when the bottle is released from the hand of the installer. As one may see in FIGS. 5 and 7, for example, the detent spring wires 46 and 47 can rest on the bottom 66 of the bracket 29. The spring wires also fit within slots 67 and 68 which provide guidance for lateral movement of the spring wires when they diverge.

We claim:

1. A device for injecting bio-enzyme material into an organic waste disposer and adapted for connection to an organic waste disposer comprising:

a container for containing bio-enzyme material a fixedly mountable detent device adapted for releasably engaging said container for containing bio-enzyme material and for holding said container in a fixed position, a pump having an inlet for being immersed in the bio-enzyme material contents of said container, said pump having a tubular member in which there is a discharge opening adapted to be connected in fluid flow communication with said organic waste disposer, said tubular member responding to being depressed by issuing a quantity of bio-enzyme material out of said discharge opening and into said disposer and an actuator adapted to be operatively connected to said waste disposer for depressing said tubular member in response to each commencement of operation of said waste disposer.

2. A device according to claim 1 wherein said container for use with said device for pumping bio-enzyme material in the form of a bottle having a longitudinal axis and a body and a neck, at least two support elements projecting radially from said neck in opposite directions away from said axis of the bottle, said detent device comprising laterally spaced apart spring elements having corresponding free end portions and corresponding opposite end portions, a push button member movably mounted on said support member for advancing and retracting said opposite end portions of said spring elements, said spring elements being fastened to said push button for said spring elements to advance in a predetermined path when said push button is manually advanced, cam elements fixedly mounted in said path for said end portions of said spring elements to be spread apart further by said free end portions acting on said cams to provide for said support elements on the neck of said bottle to pass without interference between said spring elements, retraction of said push button enabling the springiness of said spring elements to retract said push button and allow said spring elements to move toward each other and under said support elements on the bottle to thereby support the bottle.

3. A device for injecting bio-enzymes into an organic waste disposer according to claim 1 wherein said actuator includes a solenoid and an armature actuated by the solenoid, said armature being operatively coupled to said tubular member, said organic waste disposer including an electric motor for driving said disposer to grind organic waste, and an electrical circuit constructed and arranged for energizing said motor and said solenoid simultaneously to effect said issuance of said bio-enzyme material.

4. A device for withdrawing bio-enzyme material from a container and discharging said bio-enzyme material into a motor driven organic waste disposer, comprising:

a fixedly mountable container receiver adapted for releasably engaging a container for bio-enzyme material and for holding the container in a fixed position, and a container which contains a bio-enzyme material removably mountable in said container receiver and having a pump mounted therein, said pump having an inlet immersed in the bio-enzyme material contents of said container, said pump including a tubular stem in which there is a bio-enzyme material discharge port, said stem responding to being depressed by issuing a predetermined quantity of bio-enzyme material out of said discharge port and into said disposer, and an electric pump operator for depressing said tubular stem and electric circuitry including a switch controlling the circuitry to energize said pump operator and said motor of said disposer simultaneously to effect discharge of a single predetermined quantity of said bio-enzyme material into said organic waste disposer each time said motor is started.

5. In combination, an organic waste disposer which includes a grinding chamber and a device for pumping bio-enzyme material from a container to discharge said bio-enzyme material into said grinding chamber, comprising:

a support member adapted for mounting proximate to said organic waste disposer, an electric motor and a device in said chamber driven rotationally by said motor for grinding organic waste into fine particulates, a detent device on said support member operable to releasably engage a said container, a container which contains a bio-enzyme material releasably engaged by said detent device and having a pump mounted therein, said pump having a discharge conduit connected to the interior of said waste disposer grinding chamber and including a tubular member extending into a said container which engages the operating components of the pump, said tubular member having a longitudinal axis and responding to being moved axially by causing pumping of a predetermined quantity of bio-enzyme material from said container and discharging said material into said chamber of said disposer, an electroresponsive actuator responding to being electrically energized by driving said tubular member axially to effect said pumping of said bio-enzyme material, and an electric circuit including a switch operable to connect said circuit to an electric power source whereby said electroresponsive actuator and said motor of the disposer are connected to said circuit for being energized simultaneously when said switch is conductive.

6. A combination according to claim 5 wherein:

said container is a bottle having a longitudinal axis and a body and a neck, said detent device engaging said bottle at its neck to hold said bottle on said support member with said tubular member extending upwardly from said neck for being driven axially by said electroresponsive actuator.

7. In combination, an organic waste disposer and an injection device for injecting bio-enzyme material into the disposer, said disposer comprising a chamber, an electric motor and a member in said chamber for being driven rotationally by said motor to effect comminuting organic material in said chamber when said motor is energized, said chamber having an outlet through which comminuted organic material is discharged, a bracket member supporting said injection device adjacent said disposer, said injection device including a detent device that is operable to hold a container of bio-enzyme material stationarily and to alternately release said container for removal, a container which contains a bio-enzyme material releasably engaged by said detent device and having a pump mounted therein, said pump having a discharge outlet connected by a conduit to the interior of said waste disposer grinding chamber and an inlet disposed in said container and said pump including a tubular member responding to being depressed by causing said pump to discharge a predetermined quantity of bio-enzyme material from said outlet, an electroresponsive actuator responding to being energized by depressing said tubular member to effect pumping of said predetermined quantity of said bio-enzyme material, and electric circuit means including a switch for connecting said actuator and motor of said disposer to an electric power source concurrently whereby said actuator is depressed once each time said disposer is operated.

8. A combination device according to claim 7 wherein said container said is a bottle having a longitudinal axis and at least two support elements projecting therefrom in opposite directions away from said axis, said detent device comprises laterally spaced apart spring elements supported for moving bidirectionally relative to said bracket member, and cam elements constructed and arranged for causing said spring elements to separate further from each other when said spring elements are moved in one direction and are forced against said cam to provide for said support elements on the bottle to be passed between said spring elements, discontinuance of forcing said spring elements against said cam elements causing said spring elements to move oppositely of said one direction and toward each other under said support elements to thereby support said bottle relative to said bio-enzyme injection device.

9. A combination according to claim 8 wherein:

said spring elements have free end portions which separate under the influence of said cam elements and said spring elements have opposite corresponding end portions, and a push button guided for moving on said bracket member and said opposite corresponding ends of said spring elements are fastened to said push button.

10. A combination according to claim 7 wherein:

said container is a bottle and said bottle has a cap with said tubular member of said pump projecting slidably through said cap, said bracket member has a bottle receiver member comprised of longitudinally extending walls defining an annular cavity having an inside diameter and said cap has an outside diameter that is complementary in shape to said inside diameter to provide for said cap fitting tightly into said receiver for stabilizing said bottle.

11. A combination according to claim 7 wherein:

said actuator comprises an electromagnet coil and an armature that is driven in response to said coil being electrically energized for said armature to effect depressing of said tubular member of said pump, a hollow body coupled to said armature, said body having a hollow interior and an opening into which said tubular member of said pump fits and said conduit for conducting said bio-enzyme material to the organic waste disposer is a flexible tube coupled in communication with said hollow interior.

12. A combination according to claim 7 wherein said container is a bottle having a body portion for containing bio-enzyme material and a neck portion extending unitarily from said body portion, at least two bottle support elements projecting from said neck position in directions opposite from each other.

13. A combination according to claim 7 including a trim shell mounted to said organic waste disposer and said bracket member is mounted to said trim shell.

14. A combination according to claim 7 wherein the pumping capacity of said pump is such that the quantity of bio-enzyme material pumped each time said tubular member is depressed is a single quantity between one and three cubic centimeters in volume.

15. A food waste disposer, comprising:

an electric motor and a grinding chamber, a pump having an inlet adapted for communicating with a source of bio-enzyme material and having an outlet coupled to the grinder chamber, an electroresponsive pump operator that responds to being electrically energized by operating said pump to withdraw a predetermined quantity of bio-enzyme material from said source and discharge the quantity into said grinding chamber, and an electric circuit including a switch operable to connect the circuit to an electric power source, said circuit including connections to said motor and said electroresponsive pump actuator such that said pump actuator is energized to effect discharge of said quantity of bio-enzyme simultaneously with energization of the motor.

16. A food waste disposer according to claim 15 wherein:

said source of bio-enzyme material is a bottle having a longitudinal axis, a body and a neck, a support member adapted for mounting proximate to said disposer, a detent device on said support member operable to releasably engage said bottle at its neck to hold the bottle on said support member, said bottle having at least two support elements projecting radially from its neck in opposite directions away from the axis of the bottle, said detent device comprising laterally spaced apart spring elements having free end portions and corresponding opposite end portions, a push button member movably mounted to said support member and adapted to advance and retract said opposite end portions of the spring elements, said spring elements being fastened to said push button for said spring elements to advance in a predetermined path when said push button is manually advanced, and cam elements fixedly mounted in said path for said end portions of said spring elements to be spread apart further by said free end portions acting on said cams to provide for said support elements on the neck of said bottle to pass without interference between said spring elements, discontinuing manual pushing of said push button enabling the springiness of said spring elements to retract said push button and allow said spring elements to move toward each other and under said support elements on the bottle to thereby support the bottle.

17. A food waste disposer according to claim 15 wherein:

said source of bio-enzyme material is a bottle having a body and a neck, a support member adapted for mounting proximate to said disposer, a detent device on said support member for engaging said bottle at its neck to hold said bottle on the support member.

18. A food waste disposer according to claim 17 wherein:

said bottle has a cap and said inlet of the pump is in communication with the bio-enzyme material in the bottle through said cap, said support member has a bottle receiver member comprised of longitudinally extending walls defining a cavity and the cap has a shape that is substantially complementary to the shape of said cavity to provide for said cap fitting snugly in said receiver for stabilizing the bottle.

19. A food waste disposer according to claim 15 wherein said electroresponsive pump operator comprises an electromagnet coil and an armature that is driven in one direction in response to said coil being electrically energized to operate said pump and cause the pump to pump one predetermined quantity of bio-enzyme for discharge into said grinding chamber of the disposer, and a spring connected to said armature for drawing said armature oppositely of said one direction when the motor and the coil are deenergized.

20. A food waste disposer according to claim 19 wherein said predetermined quantity of bio-enzyme pumped for each operation of the pump has a volume of about between one and three cubic centimeters.

21. A method of reducing deposits of organic material in a conduit for receiving the discharge of water and ground organic material from a motor operated food waste disposer, comprising the steps of:

energizing the motor for initiating an organic material grinding operation and simultaneously injecting a predetermined quantity of bio-enzyme material into the disposer for being discharged therefrom into the conduit for the enzymes to mix with the organic material in the disposer and go into the conduit for digesting the organic material deposits.

22. A method of enhancing digestion of organic material by bio-enzymes in a septic tank comprising the steps of:

having the outlet of a food waste disposer coupled to the septic tank, and injecting a predetermined quantity of said bio-enzymes into said disposer concurrently with turning on of the disposer for grinding organic material.

* * * * *